US005778740A

United States Patent [19]

Tye

[11] Patent Number: 5,778,740

[45] Date of Patent: Jul. 14, 1998

[54] SEMI-AUTOMATIC BOTTLE CAP REMOVER

[75] Inventor: David Tye, Huntington Beach, Calif.

[73] Assignee: Universal Aqua Technologies, Inc., Santa Fe Springs, Calif.

[21] Appl. No.: 704,004

[22] Filed: Aug. 22, 1996

[51] Int. Cl.[6] ..... B67B 7/00

[52] U.S. Cl. ..... 81/3.2; 81/3.2; 81/3.25; 81/3.31; 81/3.32

[58] Field of Search ..... 81/3.2, 3.1, 3.25, 81/3.31, 3.32, 3.44

[56] References Cited

PUBLICATIONS

"Decapper Installation Manual", Blackhawk Molding Co., Inc., Addison, Illinois, Jun. 11, 1995, pp. 1–37.

*Primary Examiner*—James G. Smith
*Assistant Examiner*—Lee Wilson
*Attorney, Agent, or Firm*—D'Alessandro & Ritchie

[57] ABSTRACT

A bottle cap remover is activated by inserting a bottle into an orifice. A detector adjacent the orifice detects the presence of the bottle and causes a linear actuator to drive a gripping device away from the top of the bottle where the cap is located. As the gripping device is moving away from the bottle cap, cam members direct hooked members of the gripping device around the bottle cap so that it is pulled off of and away from the bottle as the linear actuator drives the gripping device away from the bottle top. Once the bottle cap is removed, the linear actuator recycles to ready the bottle cap remover for the next bottle cap.

5 Claims, 5 Drawing Sheets

SEMI-AUTOMATIC BOTTLE CAP REMOVER

BACKGROUND OF THE INVENTION

1. Field of the Invention

The present invention is directed to a semi-automatic demand activated mechanism for removing bottle caps from bottles prior to washing and refilling.

2. The Prior Art

Cylindrically-shaped five gallon/19 liter water bottles are ubiquitous throughout the world. These bottles have a cylindrical body with a narrow tapered neck and an opening at the top of the neck. They are found in virtually every office building and are generally used with water coolers or "dispensers" which are adapted to receive the inverted bottle. In the past, these bottles were made of heavy glass and were recycled by use of glass bottle cleaning technology. Glass bottles have in essence completely disappeared from the market having been replaced by lighter and far less breakable polycarbonate bottles. Such bottles are typically used by a customer, emptied, stored somewhere for awhile, and then picked up for re-use by a delivery person who brings new, full bottles for use by the customer. Water bottles need to be capped to seal the water in and prevent spillage and contamination. A conventional water cap 10 is shown in FIG. 1. Such conventional bottle caps are usually cylindrical and are generally made of a single piece of soft plastic which is press fit onto the water bottle after filling. The cap 10 is removed by a user pulling on tab 12 and tearing the plastic along scored line 14 so as to remove the cap. A common problem with conventional bottle caps is that when a user wants to place the water bottle on a water dispenser, the user must pull off the cap, invert the bottle, and engage it with the water dispenser. Unfortunately, water spills often result while the bottle is de-capped and inverted and not correctly positioned over the water dispenser.

Recently, new caps have been designed and marketed which reduce the spillage problem described above. Marketed under names such as "splash guard", "safegard cap" and "non-spill closure", these caps are designed to operate with a specially adapted water dispenser which engages a mechanism in the cap only when the bottle is inverted and the cap correctly positioned over the water dispenser. Only then is the cap rendered capable of passing water to the dispenser. A first such type of water bottle cap 16 is shown in FIGS. 2 and 3. An orifice 18 is provided in the bottle cap 16 and is capped by a valve mechanism 20. When stored, valve 20 is closed and water cannot leak out of the water bottle regardless of the orientation of the water bottle. When placed in an appropriate dispenser, a probe (such as a solid fixed metal rod) reaches up from the dispenser to push valve 20 up away from what is now bottom surface 22 of cap 16, opening valve 20 and allowing water from the water bottle to pass into the dispenser.

A second such type of cap 24 is shown in FIG. 4. In the cap of FIG. 4, an orifice 26 is provided in the bottom surface 28 of cap 24 as shown. The orifice includes a tubular portion 30 which is sealed with a small cylindrically shaped cap 32 which fits into tubular portion 30. A probe in the dispenser is adapted to push cap 32 out of the way and unseal the bottle as the bottle is positioned in the dispenser.

These new bottle caps pose a problem for water bottlers who take old bottles, wash them, refill them, and resell them. In the past, all bottles came back with their caps removed. With the new caps, many bottles come back with the caps still installed on the neck of the bottle. As a result, such water bottlers need to remove the old caps before the cleaning and refilling process can be conducted. Removing a large quantity of such bottle caps by hand would obviously be a highly undesirable and time consuming job for a human bottle loader.

To solve this problem, a number of companies have developed fully automatic and quite complex machinery designed to be integrated into a bottle washer and capper system. One such example is the "Decapper" sold by Blackhawk Molding Company, Inc. of Addison, Ill. The "Decapper" is a relatively sophisticated piece of industrial equipment designed to be placed in a bottle washer/capper line and take bottles on a conveyor belt, de-cap them, and pass them to the washing station. Such equipment is relatively expensive and requires integration into existing lines. Accordingly, it would be desirable to have a relatively low cost stand-alone bottle cap remover which operates quickly and efficiently to remove bottle caps on demand.

SUMMARY OF THE INVENTION

The present invention is a bottle cap remover which is activated by inserting a bottle into an orifice. A detector adjacent the orifice detects the presence of the bottle and causes a linear actuator to drive a gripping device away from the top of the bottle where the cap is located. As the gripping device is moving away from the bottle cap, cam members direct hooked members of the gripping device around the bottle cap so that it is pulled off of and away from the bottle as the linear actuator drives the gripping device away from the bottle top. Once the bottle cap is removed, the linear actuator recycles to ready the bottle cap remover for the next bottle cap.

OBJECTS AND ADVANTAGES OF THE INVENTION

Accordingly, it is an object of the present invention to provide a semiautomatic mechanism for removing plastic bottle caps from bottles.

It is a further object of the present invention to provide an on-demand semi-automatic mechanism for removing bottle caps which can stand alone from a bottle washing and filling system.

These and many other objects and advantages of the present invention will become apparent to those of ordinary skill in the art from a consideration of the drawings and ensuing description of the invention.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure. Like reference numbers are used throughout to denote like elements.

Figure 5:
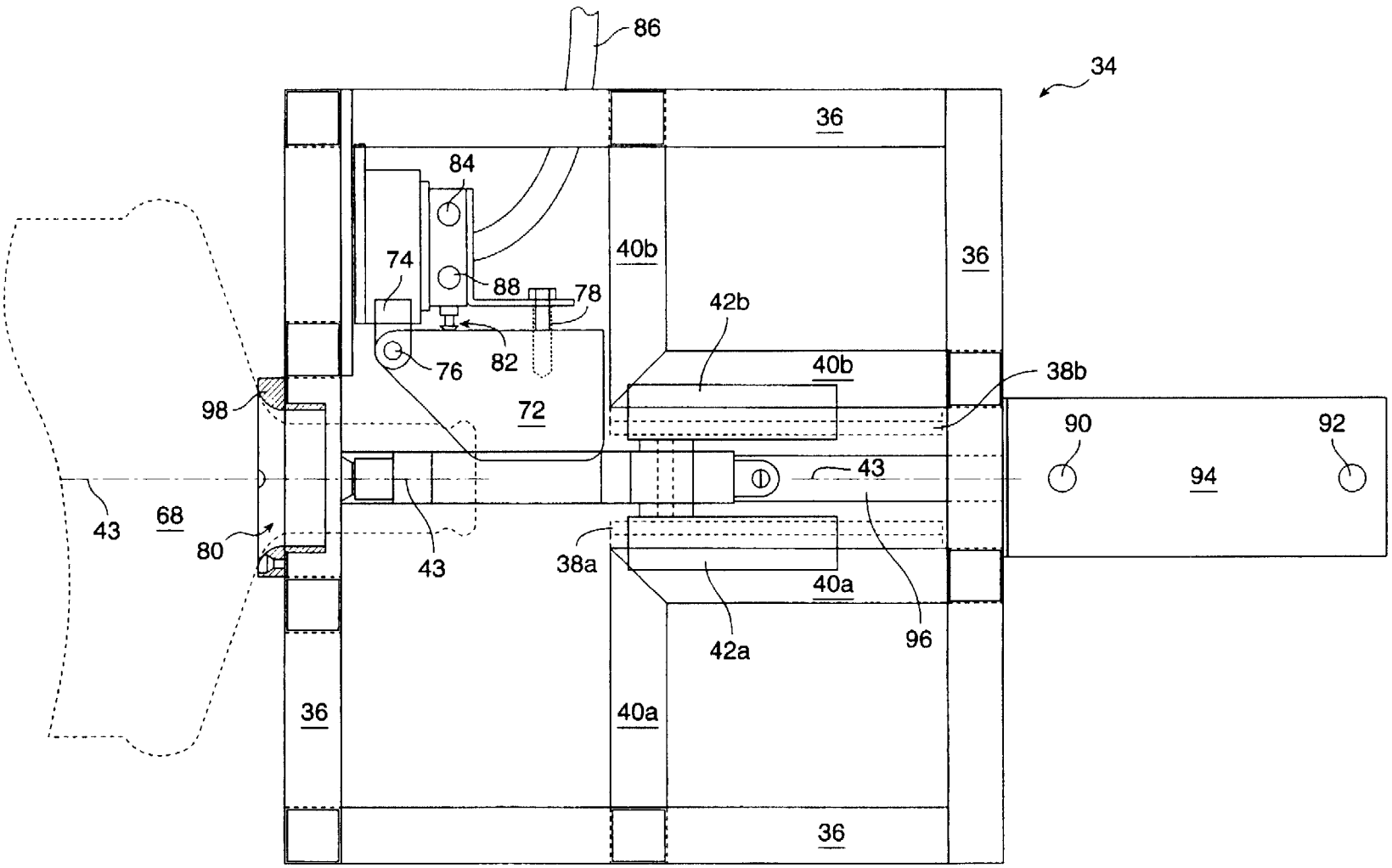
FIG. 5 is a side elevational view of a mechanism for removing water bottle caps according to a presently preferred embodiment of the present invention.

Turning now to FIG. 5, a side elevational view of a bottle cap remover mechanism 34 for removing water bottle caps according to a presently preferred embodiment of the present invention is shown. Bottle cap remover 34 includes a frame 36. To frame 36 is attached a track member 38*a*, 38*b* supported, respectively, by track support members 40*a*, 40*b*. Slider 42*a*, 42*b* (collectively denoted 42 and sometimes referred to herein as a "pivot member") respectively engages track members 38*a*, 38*b* and is free to slide to the left and to the right on track members 38*a*, 38*b* as shown in FIG. 5. Track members 38*a*, 38*b* are preferably aligned parallel to an axis 43 as shown (i.e., the axis of rotation of the bottle, or the axis orthogonal to (or at least intersecting) the plane in which orifice 80, through which the bottle top passes, is disposed).

Figure 1:
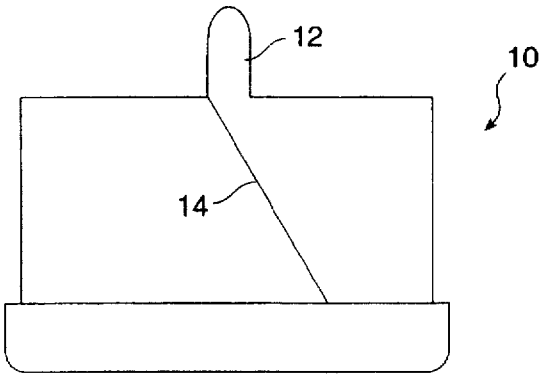
FIG. 1 PRIOR ART
FIG. 1 is a side elevational drawing of a conventional water bottle cap according to the prior art.
Figure 2:
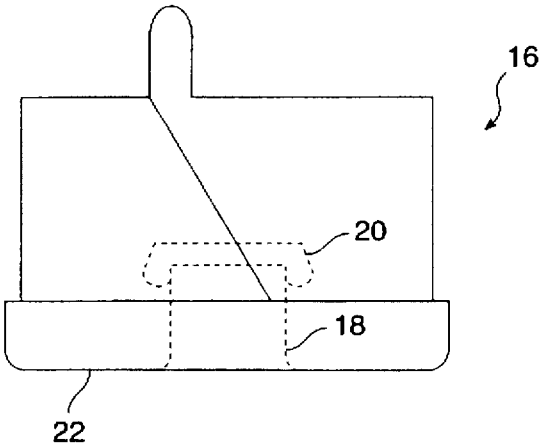
FIG. 2 PRIOR ART
FIG. 2 is a side elevational drawing of a valved water bottle cap according to the prior art.
Figure 3:
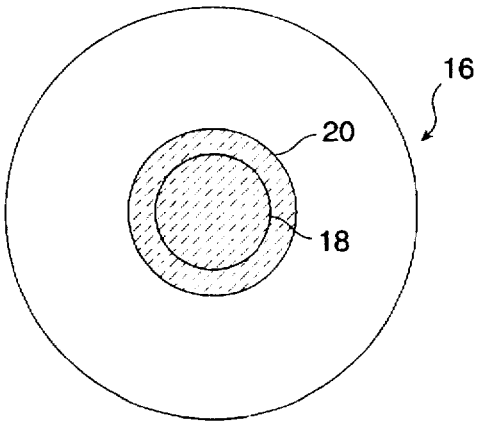
FIG. 3 PRIOR ART
FIG. 3 is a top plan view of a valved water bottle cap according to the prior art.
Figure 4:
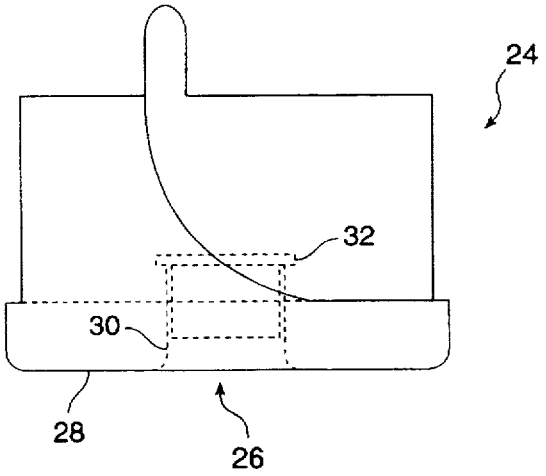
FIG. 4 PRIOR ART
FIG. 4 is a side elevational drawing of a stoppered water bottle cap according to the prior art.
Figure 6:
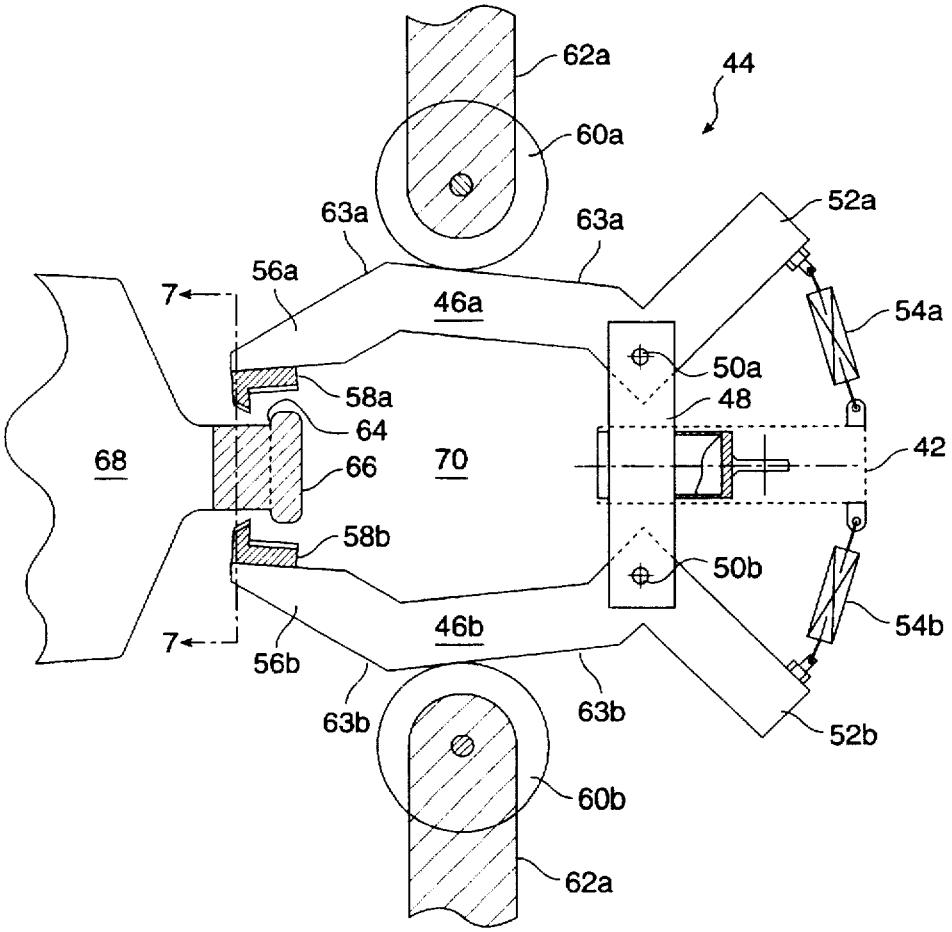
FIG. 6 is a top plan view of a mechanism for removing water bottle caps according to a presently preferred embodiment of the present invention.
Figure 7:
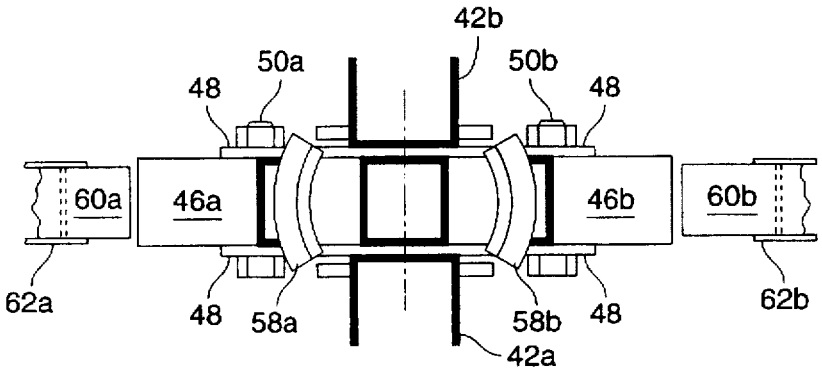
FIG. 7 is a sectional view taken along lines 7—7 of FIG. 6 of a mechanism for removing water bottle caps according to a presently preferred embodiment of the present invention.

Turning to FIGS. 6 and 7, gripping mechanism 44 is shown. Gripping mechanism 44 is attached to slider 42 and operates as slider 42 moves back and forth on track members 38*a*, 38*b*. Gripping mechanism 44 includes a pair of arms 46*a*, 46*b* which are pivotally mounted to cross member 48 (part of slider 42) respectively at pivot points 50*a*, 50*b*. Cross member 48 is rigidly attached to slider 42 as shown. Arms 46*a*, 46*b* are respectively biased at rear portions 52*a*, 52*b* toward slider 42 and axis 43 by (first) biasing means 54*a*, 54*b* which may be any elastic member but is preferably a spring held in tension. Arms 46*a*, 46*b* are each provided with a hook-shaped member 58*a*, 58*b* designed to engage a bottle cap. When no countervailing force is applied to front portions 56*a*, 56*b*, arms 46*a*, 46*b* tend to position themselves so as to provide a maximum distance between hook-shaped members 58*a*, 58*b*. A countervailing force (second biasing means) is applied by cam rollers 60*a*, 60*b* (also referred to herein as "cam members") which act to bias front portions 56*a*, 56*b* of arms 46*a*, 46*b* toward axis 43 in accordance with the shape of arms 46*a*, 46*b*.

Cam rollers 60*a*, 60*b* are positioned on supports 62*a*, 62*b* so as to engage arms 46*a*, 46*b* as slider 42 travels to the right and left as shown in FIG. 6. When slider 42 moves to the right, the shape of an outer surface 63*a*, 63*b* of arms 46*a*, 46*b* is such that hook-shaped members 58*a*, 58*b* are forced closer together behind lip 64 of bottle cap 66 on bottle 68 so as to engage lip 64. As slider 42 continues its motion to the right, cap 66 is pulled off of bottle 68 and is free to fall downward. A sack or box (not shown) may be placed below the opening 70 to catch falling caps for disposal or recycling. Those of ordinary skill in the art will recognize that many possible shapes for outer surfaces 63*a*, 63*b* are possible as long as the function of closing hook-shaped members 58*a*, 58*b* is achieved before they pass beyond lip 64. Those of ordinary skill in the art will also realize that while cam rollers are presently preferred as cam members to bias or push against outer surfaces 63*a*, 63*b* of arms 46*a*, 46*b*, other devices could easily be substituted to accomplish the same task, such as rigid members and the like. Rollers are presently preferred in order to minimize friction and wear.

Turning now to FIG. 5, a mechanism for automatically activating the bottle cap remover 34 is shown. A trigger 72 is pivotally mounted to bracket 74 at pivot point 76. When no bottle 68 is present, spring 78 biases trigger 72 down into the path of bottle 68 through orifice 80. Many configurations other than that shown may be used as will readily appear to those of ordinary skill in the art. Electric eye-type mechanisms could also be used as those of ordinary skill in the art will readily appreciate. When trigger 72 drops into the path of bottle 68, switch 82 becomes deactivated. When a bottle 68 is inserted in orifice 80, trigger 72 causes activation of switch 82. In a presently preferred embodiment, switch 82 is a pneumatic switch which directs air flow when closed to a first port 84 from air source 86 and when open to a second port 88. Corresponding ports 90, 92 in pneumatic air ram 94 control whether pneumatic air ram 94's linear actuator member 96 ("coupling") is extended to the left in FIG. 5 or retracted to the right in FIG. 5. Thus, when a bottle 68 is inserted in orifice 80, trigger 72 is pushed back and up, causing switch 82 to activate, pneumatic air ram 94 to retract, and linear actuator member 96 to move to the right. When bottle 68 is removed, trigger 72 is forced away from engagement with switch 82, the pneumatic air ram 94 air supply is reversed, and pneumatic air ram 94 extends, moving linear actuator member 96 to the left. Since linear actuator 96 is attached to slider 42, the motion of linear actuator 96 causes corresponding motion of slider 42 along track members 38*a*, 38*b*. Those of ordinary skill in the art will realize that an electrically operated solenoid of suitable power and size could be used to replace pneumatic air ram 94 and air operated switch 82 could similarly be replaced with a suitable electronic switch or photodetector arrangement.

Turning to FIG. 5, an ultra high density polymer (soft plastic) insert 98 surrounds orifice 80 so as to avoid marring the surface of bottle 68.

Figure 8:
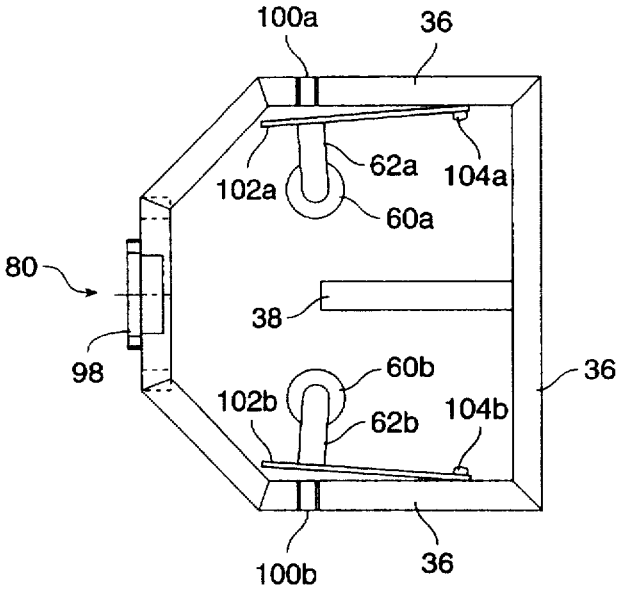
FIG. 8 is a top plan view of a portion of a mechanism for removing water bottle caps according to a presently preferred embodiment of the present invention.

Turning now to FIG. 8, cam rollers 60*a*, 60*b* may be adjusted in position by set screws 100*a*, 100*b* as shown. This is achieved by mounting supports 62*a*, 62*b* to a hinged flap 102*a*, 102*b* having a hinge 104*a*, 104*b* as shown.

Figure 9:
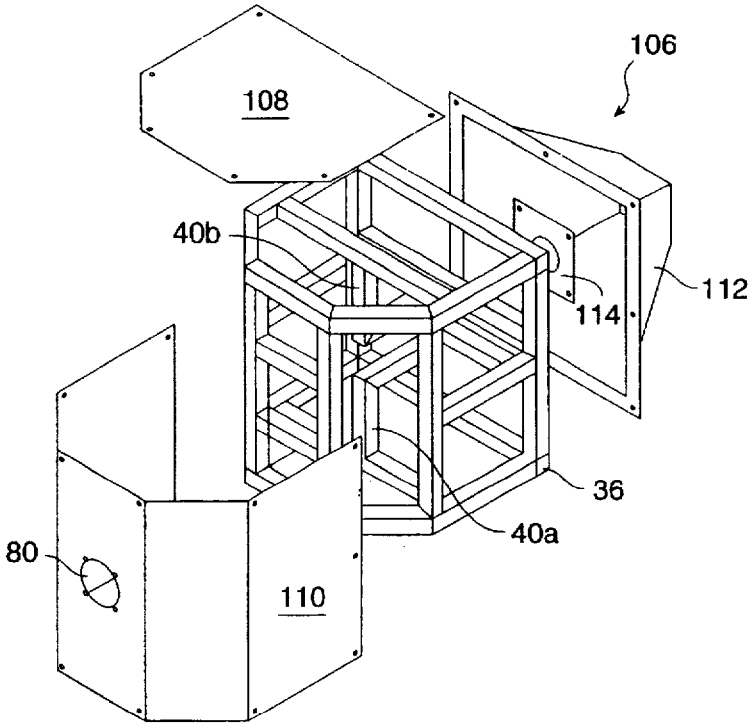
FIG. 9 is a perspective view of the frame and cover for a mechanism for removing water bottle caps according to a presently preferred embodiment of the present invention.

Turning now to FIG. 9, the housing 106 for the cap puller 34 is shown. To frame 36 is attached a top cover 108, a front cover 110 having an orifice 80 and a rear cover 112 and pneumatic air ram mounting bracket 114.

Figure 10:
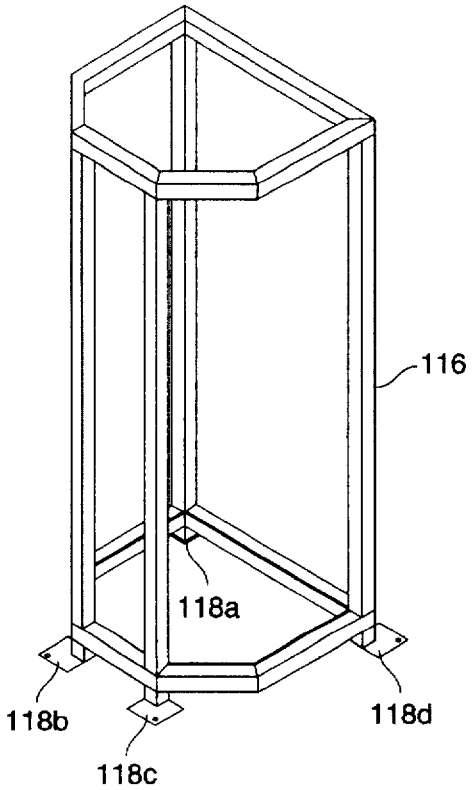
FIG. 10 is perspective view of a stand for supporting the frame and cover for a mechanism for removing water bottle caps according to a presently preferred embodiment of the present invention shown in FIG. 9.

Housing 106 is in turn mounted on stand 116 shown in FIG. 10. Stand 116 is preferably mounted to a floor with mounting flanges 118*a*, 118*b*, 118*c*, 118*d*.

According to a presently preferred embodiment of the present invention, as pointed out above, all functions are powered by a source of compressed gas, preferably air, thus no electrical connections at all need to be made to or within bottle cap remover 34. This aids in the prevention of electrical shock injuries and failures due to short circuits.

Alternative Embodiments

Although illustrative presently preferred embodiments and applications of this invention are shown and described herein, many variations and modifications are possible which remain within the concept, scope, and spirit of the invention, and these variations would become clear to those of skill in the art after perusal of this application. The invention, therefore, is not to be limited except in the spirit of the appended claims.

What is claimed is:

1. A semiautomatic bottle cap remover for removing a bottle cap from a bottle, said bottle cap remover comprising:

a housing having an orifice for insertion of a bottle;

a pneumatic air ram adapted so as to control movement of a coupling along a direction parallel to an axis intersecting a plane in which said orifice is disposed;

detection means including a lever connected to an air valve having a first port, a second port and a third port, wherein said fast port is connected to a source of pressurized gas, said second port is connected to a first port of said pneumatic air ram, and said third point is connected to a second port of said pneumatic air ram, said detection means located adjacent said orifice for detecting when the bottle is inserted into said orifice;

said detection means coupled to said pneumatic air ram, said pneumatic air ram adapted to move to and remain at a first position away from said orifice while a bottle is inserted into said orifice and to return to a second position closer to said orifice than said first position at other times;

at least one track member mounted to said housing and oriented along a direction parallel to said axis;

a slider coupled to said pneumatic air ram and mounted to said at least one tack member and slidable thereon alone a direction parallel to said axis;

a pair of arms pivotally mounted to said slider at a pivot point, each of said pair of arms having a front portion forward of said pivot point and a rear portion rearward of said pivot point, said front portion oriented closer to said orifice than said rear portion;

fist biasing means for biasing said rear portion toward said axis;

a cam member mounted to said housing for biasing said front portion toward said axis;

a hook-shaped member attached to said front portion for engaging and removing a bottle cap; and each of said pair of arms having a surface, said surface shaped so that in engaging with said cam member, as said pneumatic air ram moves from said second position toward said first position, said hook-shaped member closes toward the bottle cap and pulls it off of the bottle.

2. A semiautomatic bottle cap remover for removing a bottle cap from a bottle, said bottle cap remover comprising:

a housing having an orifice for insertion of a bottle:

detection means adjacent said orifice for detecting when the bottle is inserted into said orifice:

a linear actuator adapted to position a coupling parallel to an axis of said orifice between a first position and a second position, said first position being farther away from said orifice than said second position;

said detection means operatively coupled to said linear actuator, said linear actuator adapted to move to and remain at said first position while a bottle is inserted into said orifice and to return to said second position at other times;

a pivot member coupled to said linear actuator;

a first and second arm pivotally mounted to said pivot member at respective first and second pivot points, each said arm having a front portion forward of said respective first and second pivot points and a rear portion rearward of said respective first and second pivot points, said front portion oriented closer to said orifice than said rear portion;

a pair of hook-shaped members attached to each said front portion for engaging and removing a bottle cap;

a pair of first biasing means for biasing each said rear portion toward said axis; and a pair of cam rollers each mounted on plates hinged to said housing for biasing said front portion toward said axis through compressional contact with a surface of said front portion, said surface shaped so that in engaging with said cam rollers, as said linear actuator moves from said second position toward said first position, said hook-shaped members close about the bottle cap and pull it off of the bottle.

3. The apparatus in claim 2, wherein said linear actuator is an electric solenoid.

4. The apparatus in claim 2, wherein said pair of first biasing means are springs in tension.

5. The apparatus in claim 2, wherein said surface is an outer surface of said arm.

* * * * *

UNITED STATES PATENT AND TRADEMARK OFFICE

CERTIFICATE OF CORRECTION

PATENT NO. : 5,778,740

DATED : July 14, 1998

INVENTOR(S) : David Tye

It is certified that error appears in the above-identified patent and that said Letters Patent is hereby corrected as shown below:

---On Col. 5, line 32, replace "alone" with --along--.

Signed and Sealed this

Sixth Day of April, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,778,740
DATED : July 14, 1998
INVENTOR(S) : David Tye

It is certified that error appears in the above-identified patent and that said Letters Patent is hereby corrected as shown below:

Title page,
"References Cited", insert:

-- U.S. PATENT DOCUMENTS

| | | | |
|---|---|---|---|
| 2,732,741 | 1/1956 | Muller-Strobel | 81/3.2 |
| 3,037,407 | 6/1962 | MacLaren | 81/3.2 |
| 4,358,970 | 11/1982 | Jacobson | 81/3.2 |
| 5,255,574 | 10/1993 | Wuerschum | 81/3.2 |
| 5,301,433 | 4/1994 | Rogers | 81/3.32 |
| 5,517,740 | 5/1996 | Costlow et al. | 81/3.2 -- |

Column 5,
Line 31, replace "tack" with -- track --.
Line 39, replace "fist" with -- first --.

Drawings,
Sheet 2, FIG. 6, the lowermost reference number, replace "62a" with -- 62b --.

Signed and Sealed this

Twenty-third Day of April, 2002

*Attest:*

*Attesting Officer*

JAMES E. ROGAN
*Director of the United States Patent and Trademark Office*